United States Patent [19]

Stacy

[11] Patent Number: 4,747,633

[45] Date of Patent: May 31, 1988

[54] DISPOSABLE SCOOP AND CONTAINER

[76] Inventor: Thomas M. Stacy, 10150 Boone Cir., Bloomington, Minn. 55438

[21] Appl. No.: 57,042

[22] Filed: Jun. 3, 1987

[51] Int. Cl.[4] ..... A01K 29/00

[52] U.S. Cl. ..... 294/1.3; 15/257.6; 229/41 B; 294/25

[58] Field of Search ..... 294/1.3–1.5, 294/25, 55; 15/104.8, 257.1, 257.6; 206/496; 229/41 B, 103, 115

[56] References Cited

U.S. PATENT DOCUMENTS

| | | | |
|---|---|---|---|
| 2,957,617 | 10/1960 | Bolding | 229/41 B |
| 2,982,465 | 5/1961 | Fallert | 229/41 B |
| 3,534,424 | 10/1970 | Levinson | 15/257.1 X |
| 3,685,088 | 8/1972 | Doherty | 294/1.3 |
| 3,857,597 | 12/1974 | Young | 294/1.3 |
| 4,148,510 | 4/1979 | Brack et al. | 294/1.3 |
| 4,188,055 | 2/1980 | Green | 294/1.3 |
| 4,200,319 | 4/1980 | Cooper | 294/1.4 |

FOREIGN PATENT DOCUMENTS

| | | | |
|---|---|---|---|
| 462585 | 3/1951 | Italy | 294/25 |

*Primary Examiner*—Johnny D. Cherry

*Attorney, Agent, or Firm*—Paul L. Sjoquist

[57] ABSTRACT

A disposable scoop and container having a pair of foldable hinged panels, each of the panels having foldable side panels and a front panel, which may be folded into compact flat form and may be unfolded to form a scoop cavity, wherein one of the scoops may be recessible into the other scoop, and locking tabs for holding one scoop in recessed locked position within the other scoop.

12 Claims, 5 Drawing Sheets

DISPOSABLE SCOOP AND CONTAINER

BACKGROUND OF THE INVENTION

1. Field of the Invention

The present invention relates to scoops and containers and, more particularly, to collapsible and disposable scoops and containers for collecting and disposing of animal waste and the like.

2. Description of the Prior Art

Scoops and containers for retrieving and disposing of animal waste may take a permanent and reusable form or a disposable form. Permanent and reusable scoops are primarily utilized by homeowners on their residential properties. Disposable scoops and containers are utilized on city and park lands where city ordinances require the collection and disposal of animal wastes.

The Allan et al U.S. Pat. No. 3,971,503 discloses a disposable scoop and container having an elongated, tubular body with a hinged cover. The cover doubles as a scoop to retrieve the waste and allow it to pass into the tubular body where it is contained. After the waste is deposited into the tubular body, the cover is locked to the body by bending a corner of the body and inserting a corner of the cover under the bent corner.

SUMMARY OF THE INVENTION

A feature of the present invention is a scoop that is erectable from a collapsed, compact form to an expanded, operational form. In the compact form the scoop is flat and in the operational form the scoop has the pair of jaws with waste-containable cavities formed therein.

Another feature of the present invention is a set of braces to lend rigidity to the jaws in the expanded form. The braces lie flat in the collapsed form and expand with the jaws to brace the scoop in its expanded, operational form.

Still another feature of the present invention is a pair of locking tabs to lock the jaws together after the waste has been collected. The locking tabs are connected to one jaw and are inserted into a pair of tab-receiving slots formed in the other jaw to lock the jaws.

Still another feature of the present invention is a pair of hinged jaws cooperating to retrieve and contain waste. Each jaw may have a set of teeth for readily scooping the waste and a cavity for containing the waste after it has been scooped.

An advantage of the present invention is that the scoop may be conveniently portable in its collapsed, compact form. In the compact form, the scoop is easily insertable into a pocket, which allows free use of the hands while walking one's pet.

Another advantage of the present invention is that the scoop is easily transformed from its compact form to its operational form. By folding the jaws outwardly, the scoop is expanded and the braces are moved automatically into position to rigidify the scoop for operation.

Still another advantage of the present invention is that the scoop may be operated by one hand to retrieve the waste, leaving one hand free to perhaps control a pet. A handle is connected to each jaw to allow each jaw to be independently controlled as the waste is being scooped.

Still another advantage of the present invention is a feature that allows one jaw to overlap the other. The overlapping feature not only ensures complete containment of the waste but in effect allows the waste to be scooped and collected almost simultaneously.

Still another advantage of the present invention is that the scoop may be locked to contain the waste. The locking tabs allow the waste to be safely contained until the scoop and its waste material can be disposed of properly.

Still another advantage of the present invention is that the scoop is disposable. It may be constructed from inexpensive disposable and biodegradable materials such as cardboard.

Still another advantage of the present invention is that the scoop is substantially one piece and its elements are substantially integrally connected. Therefore it may be efficiently stamped from materials such as cardboard.

DESCRIPTION OF THE PREFERRED EMBODIMENTS

Figure 1:
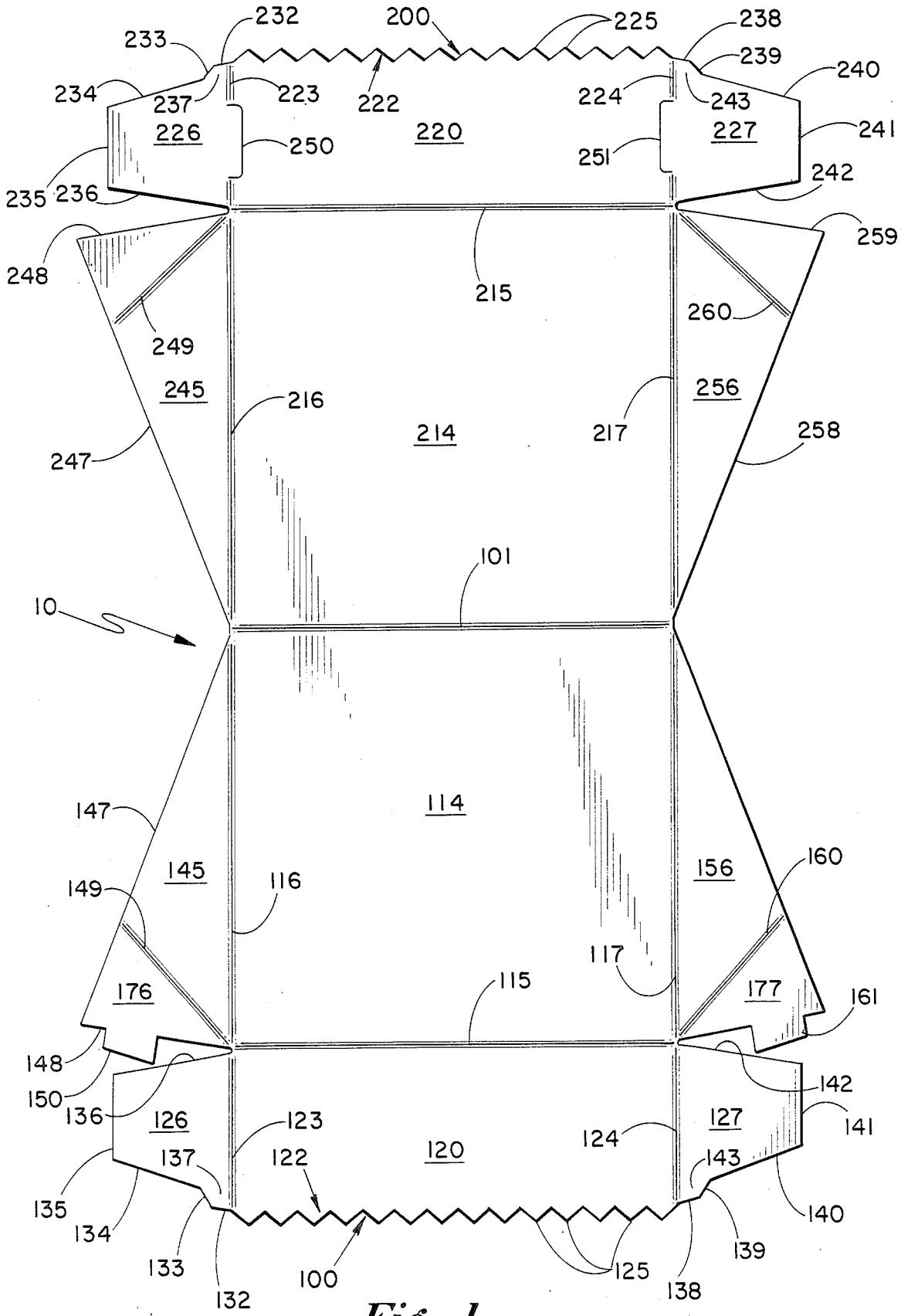
FIG. 1 is a plan view of a die-cut from which the scoop and container may be formed.

As shown by the die-cut in FIG. 1, a scoop and container 10 has a first jaw 100 and a second jaw 200. A linearly creaseable connection 101 hingedly and integrally connects the first and second jaws 100 and 200.

The first jaw 100 has a first main planar panel 114; panel 114 has four edges, 101 and 115–117, and is formed substantially, in the shape of a square. The edges 101 and 115–117 form the circumference of the square panel 114.

Edge 115 forms a linearly creaseable hinged connection to a first front planar panel 120. The hinged connection may extend for the entire length of edge 115.

The front panel 120 has a bottom edge 122, and a pair of side edges 123, 124. The panel 120 is formed substantially in the shape of a rectangle, although a set of teeth 125 may be integrally formed along the bottom edge 122.

A pair of braces 126 and 127 are connected to panel 120 along a creaseable hinged connection with edges 123 and 124.

Edges 132–136 form the outer circumference of brace 126. Edges 132 and 133 form a nub 137 which lies near the bottom edge 122 of panel 120. Edges 134 and 136 extend inwardly so that brace 126 tapers away from panel 120.

Edges 138–142 form the outer circumference of brace 127. Edges 138 and 139 form a nub 143 which lies near the bottom edge 122 of panel 120. Edges 140 and 142 extend inwardly so that brace 127 tapers away from panel 120.

A linearly creaseable hinged connection connects a side panel 145 to the edge 116 of the main panel 114. The hinged connection may extend along the entire length of edge 116.

The side panel 145 has a tab 150, but otherwise is formed in the shape of a triangle. A foldable linear crease 149 extends from the intersection of edges 116 and 148 to edge 147 at about a 45° angle from edge 116. Tab 150 is integrally connected to edge 148 of side panel 145; tab 150 is formed substantially in the shape of a trapezoid.

A linearly creaseable hinged connection connects a side panel 156 to the edge 117 of the main panel 114. Side panel 156 is formed essentially identically to side panel 145, with a tab 161 and a foldable linear crease 160.

The second jaw 200 has a second main planar panel 214 integrally connected to the first jaw 100 along edge 101. The panel 214 has four edges 101, 215–217, and is formed substantially in the shape of a square.

A linearly creaseable connection hingedly and integrally connects a bottom edge of a second front panel 220 to edge 215 of main panel 214. The hinged connection may extend for the entire length of edge 215.

The front panel 220 has a top edge 222, and a pair of side edges 223, 224. The panel 220 is formed substantially in the form of a rectangle, although a second set of teeth 225 may be integrally formed along to edge 222.

A pair of braces 226, 227 are connected to panel 220. A linearly creaseable connection along edge 223 hingedly and integrally connects the brace 226 to panel 220. The hinged connection may extend partially along the length of edge 223. A linearly creaseable connection along edge 224 hingedly and integrally connects the brace 227 to the panel 220. The hinged connection may extend partially along the length of edge 224.

Edges 232–236 form the outer circumference of brace 226. Edges 232 and 233 form a nub 237 which lies near the top edge 222 of panel 220. Edges 234 and 236 extend inwardly so that brace 226 tapers away from panel 220.

Edges 238–242 form the outer circumference of brace 227. Edges 238 and 239 form a nub 243 which lies near the top edge 222 of panel 220. Edges 240 and 242 extend inwardly so that brace 227 tapers away from panel 220.

A linearly creaseable hinged connection along edge 216 integrally connects a side panel 245 to the main panel 214. The hinged connection may extend along the entire length of edge 216.

The side panel is formed in the shape of a triangle. Edges 247 and 248 form acute angles with edge 216. A foldable linear crease 249 extends from the intersection of edges 216 and 248 to edge 247 at about a 45° angle from edge 216.

A linearly creaseable hinged connection along edge 217 integrally connects a side panel 256 to the main panel 214. The hinged connection may extend along the entire length of edge 217.

The side panel 256 is formed in the shape of a triangle. Edges 258, 259 form acute angles with edge 217. A foldable linear crease 260 extends from the intersection of edges 217 and 259 to edge 258 at about a 45° angle from edge 217.

Figure 8:
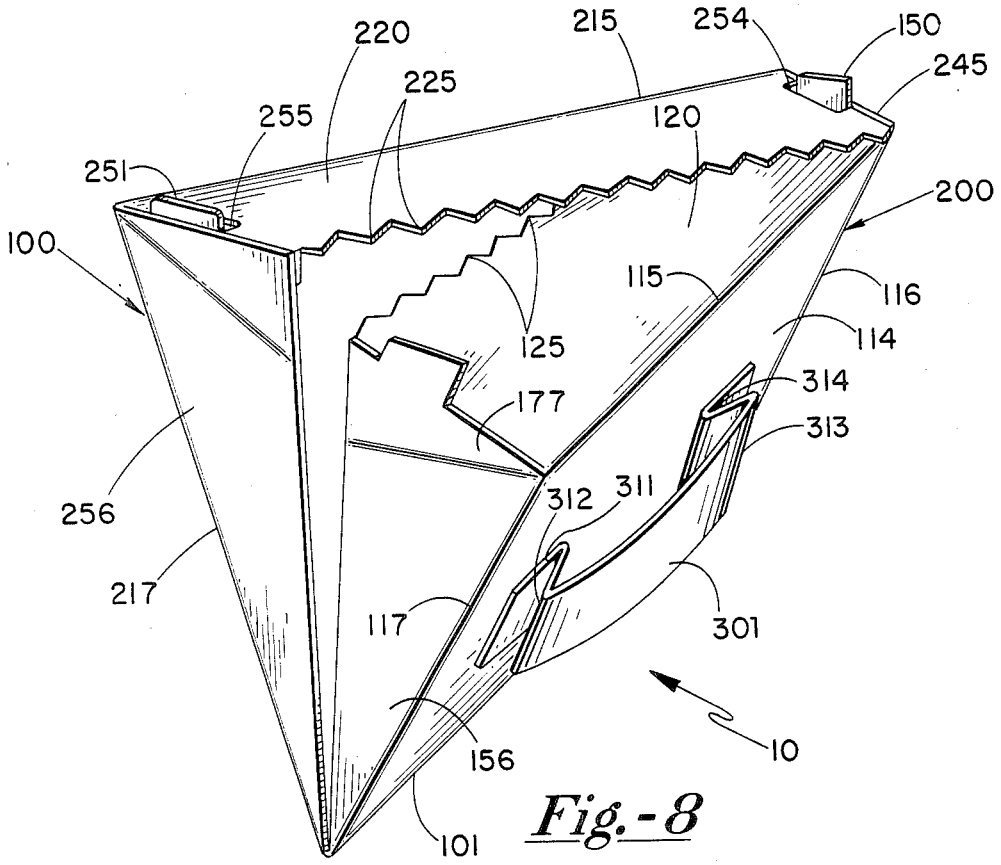
FIG. 8 is a perspective view of the scoop and container partially locked.

A pair of U-shaped perforations 250–251 are formed in front panel 220. The perforations 250–251 extend inwardly from the respective edges 223, 224 to form a pair of extensions to the respective braces 226 and 227. A pair of tab-receiving slots 254, 255 are formed in the front panel 220 by the respective U-shaped perforations 250–251 when the scoop is in the expanded form as shown in FIG. 8.

Figure 5:
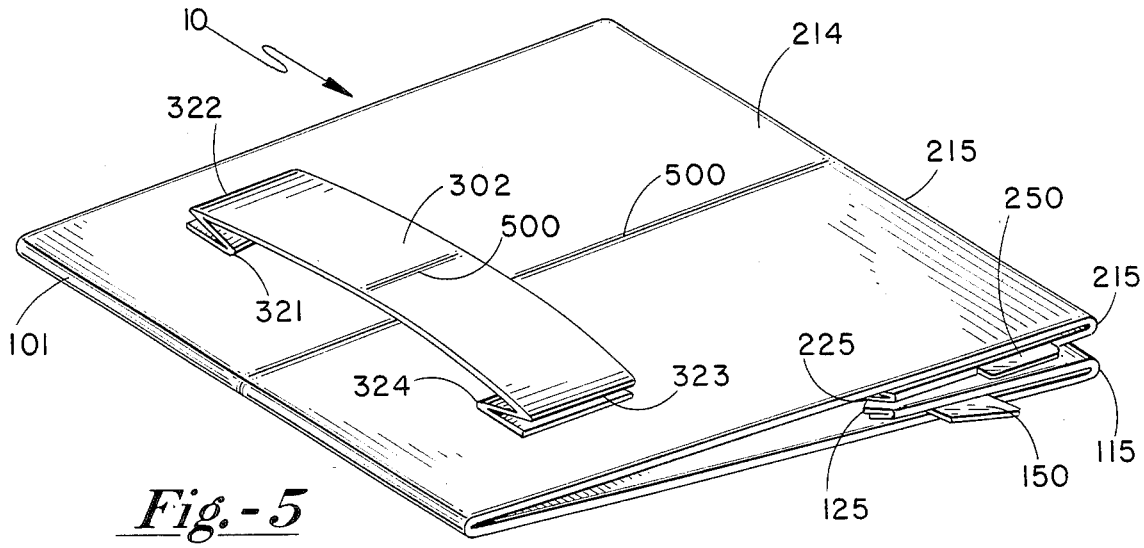
FIG. 5 shows a side view of the scoop and container in its collapsed, compact form.
Figure 7:
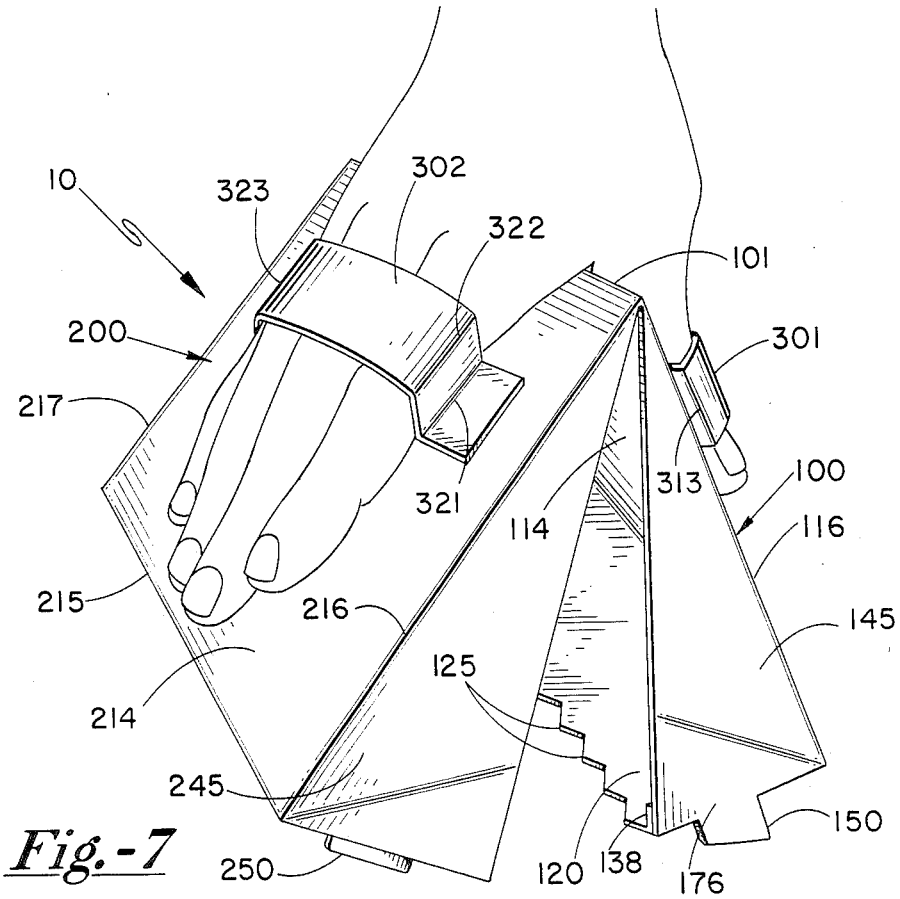
FIG. 7 shows a perspective view of the scoop and container in its expanded operational form.

A pair of handles 301–302 (FIG. 7) are connected to the first and second jaws 100 and 200 respectively. Handle 301 is connected to the outer face of panel 114 and handle 302 is connected to the outer face of panel 214. Handles 301–302 have a plurality of respective transverse creases 311–314 and 321–324 as shown in FIGS. 7 and 8. The creases 311–314 and 321–324 allow the handles 301–302 to lie flat in the compact, collapsed form as shown in FIG. 5 and to expand to an operational form as shown in FIG. 7 so that the scoop and container 10 may be operated by one hand.

Figure 2:
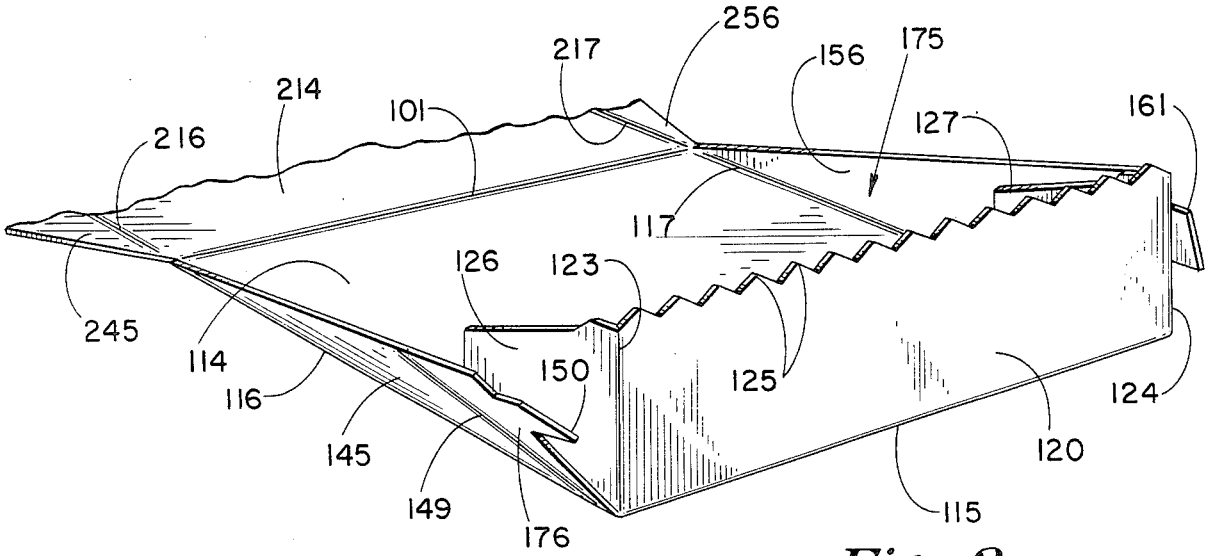
FIG. 2 is a perspective view of a first jaw of the scoop and container as it is being formed from the die-cut.

As shown in FIG. 2, a first scoop opening or cavity 175 is formed by folding the panels 120, 145 and 156 upwardly along the creaseable edges 115, 116 and 117 respectively. In forming the first scoop opening 175, a first step may be to fold panel 120 upwardly along hinged edge 115. After the panel 120 has been folded to an acute angular relationship with main panel 114, braces 126 and 127 are folded inwardly along creaseable edges 123 and 124 respectively so that edge 136 of brace 126 lies linearly adjacent edge 116 and edge 142 of brace 127 lies linearly adjacent edge 117. After the braces 126, 127 have been folded into place, side panels 145 and 156 are folded upwardly along edges 116, 117 respectively so that the inside faces of the side panels 145 and 156 lie adjacent the outside faces of the braces 126 and 127.

After the side panels 145–156 have been folded to lie facially adjacent the braces 126–127, the side panels 145 and 156 are connected to the braces 126–127, respectively. A portion 176 of the inside face of side panel 145, as defined by linear crease 149, is facially connected, as by gluing, to the outside face of brace 126. A portion 177 of the inside face of the side portion 156, as defined by linear crease 160, is facially connected, as by gluing, to the outside face of brace 127. FIG. 2 shows panel 145 in the process of being folded upwardly to connect with brace 126 and panel 156 connected to brace 127 with tab 161 protruding beyond a plane defined by the front panel 120.

Figure 3:
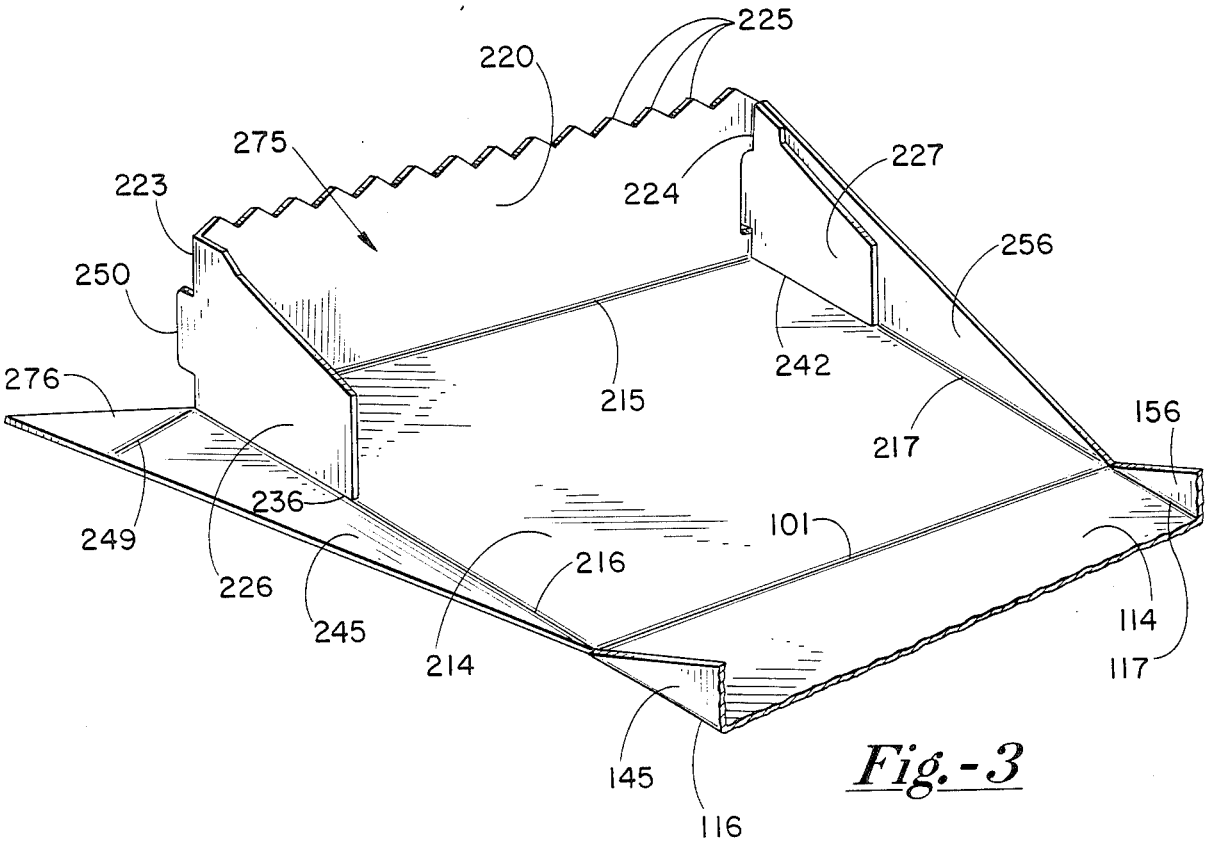
FIG. 3 is a perspective view of a second jaw of the scoop and container as it is being formed from the die-cut.

As shown in FIG. 3 a second scoop opening or second cavity 275 is formed from panels 214, 220, 245 and 256. First, to form cavity 275, panel 220 may be folded upwardly along edge 215 to an acute angular relationship with panel 214. Second, braces 226 and 227 are folded inwardly along edges 223 and 224 respectively so that edge 236 lies linearly adjacent edge 216, and edge 242 lies linearly adjacent edge 217. Third, side panels 245 and 256 are folded upwardly along edges 216, 217 respectively. Fourth, a portion 276 of the inside face of side panel 245, as defined by linear crease 249, is facially connected, as by gluing, to brace 226. Fifth, a portion 277 of the inside face of side panel 256 as defined by linear crease 260, is facially connected, as by gluing, to the outside face of brace 227. FIG. 3 shows panel 256 connected to brace 227 and panel 245 in the process of being folded to connect to brace 226.

Figure 4:
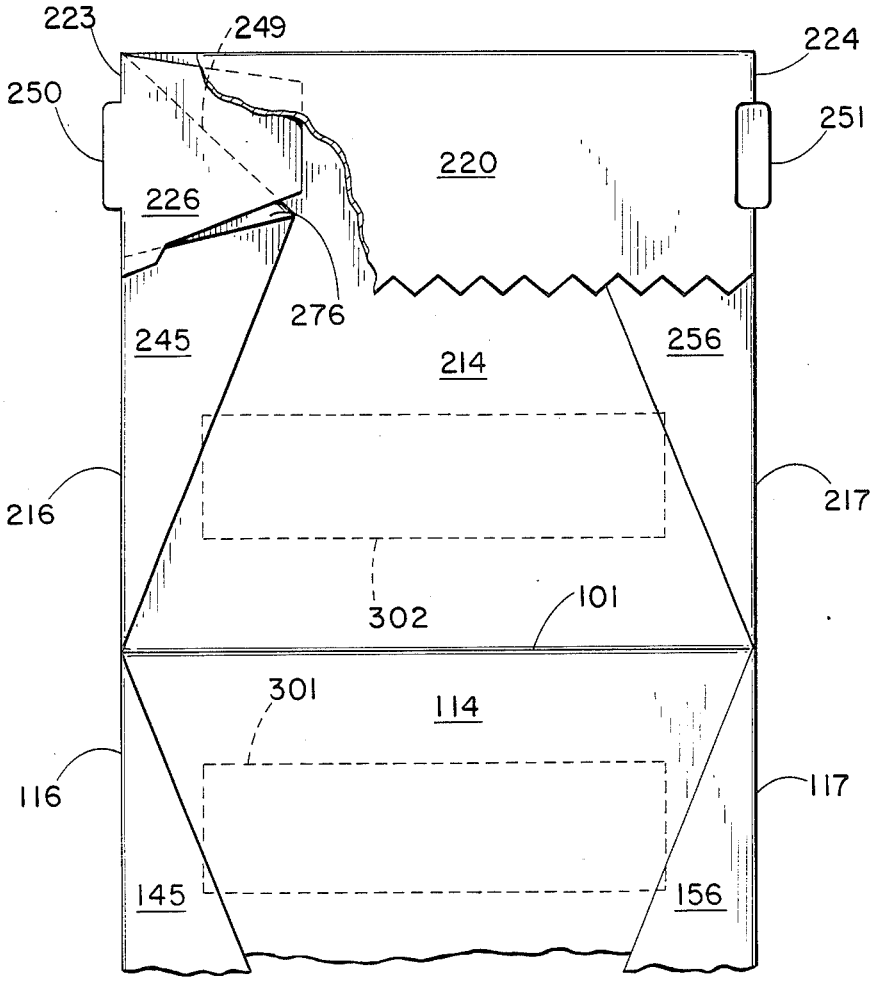
FIG. 4 shows a plan view of a jaw and in particular shows the braces lying flat and uncreased in the collapsed form of the scoop and container.

To fold the scoop 10 into a collapsed form as shown in FIGS. 4 and 5 from the erected, fabricated form as shown in FIGS. 2 and 3, the side panels 145, 156, 245 and 256 are folded inwardly along their respective hinged edges 116, 117, 216 and 217, and along their respective linear creases 149, 160, 249 and 260. As the side panels 145, 156, 245 and 256 are folded inwardly, the braces 126, 127, 226 and 227 also fold inwardly to the inside faces of front panels 120 and 220 along hinged edges 123, 124, 223 and 224. As the side panels 145, 155, 245 and 255 and braces 126, 127, 226 and 227 are being folded inwardly front panels 120 and 220 also begin to fold inwardly until the scoop 10 lies flat. FIG. 5 also shows a further fold line 500, which may be used to enable scoop 10 to be folded into a package of smaller size.

As shown in FIG. 4, the braces 226 and 227 lie in a planar orientation in the collapsed, compact form of the scoop 10. The portions 276 and 277 of the side panels 245 and 256 remain facially connected to braces 226 and 227 respectively in the collapsed form.

Figure 6:
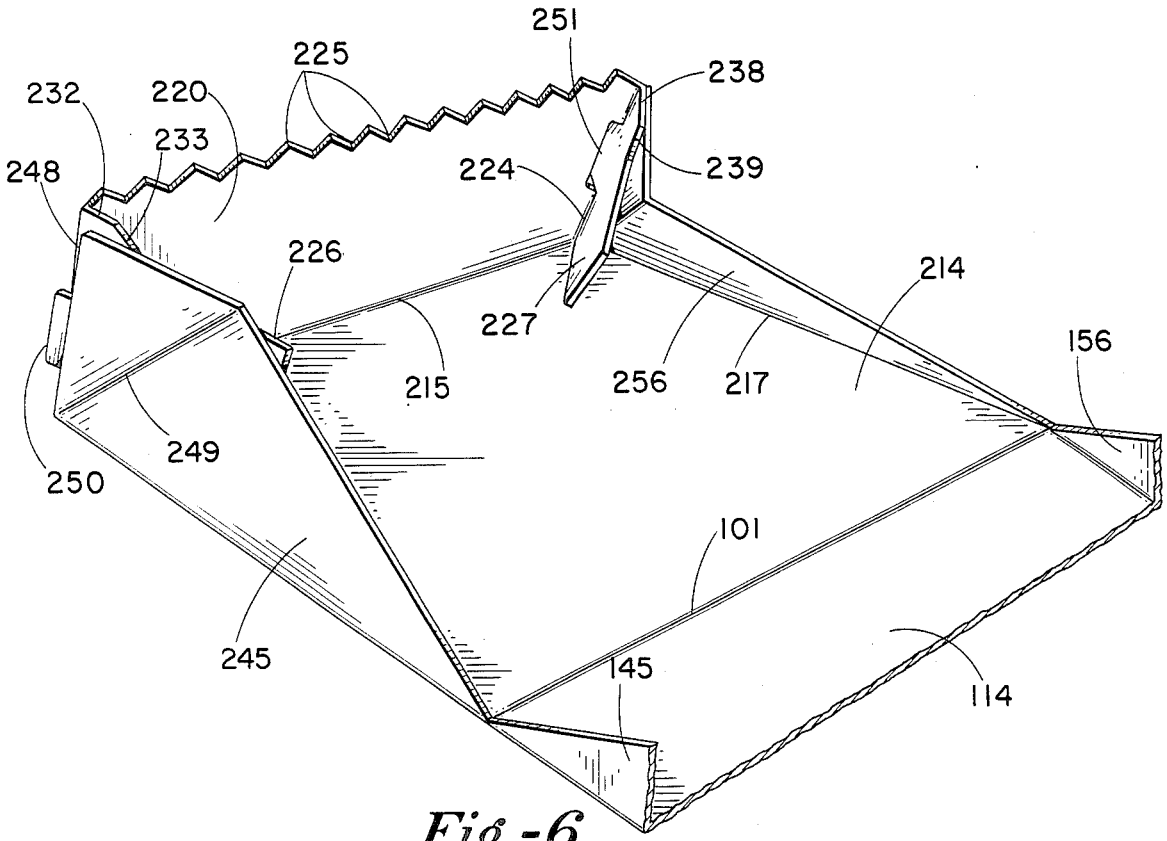
FIG. 6 shows a perspective view of a jaw as it is being erected from a collapsed, compact form to the expanded operational form.

As shown in FIG. 6, the scoop 10 is erectable from the collapsed, compact form to an expanded, operation form by folding outwardly the side panels 145, 156 and 245, 256. As the side panels are being folded outwardly the braces move outwardly to lie facially adjacent the inside faces of side panels. As the braces move outwardly, the edges of the braces may slide frictionally along the inside face of main panels 114, 214. Braces 126 and 127 support side panels 145 and 156 in an open, expanded position relative to main panel 114, to form cavity 175. It will be appreciated that the second jaw 200 is erected in substantially the same manner as first jaw 100.

The scoop and container 10 is in an operational form as shown in FIG. 7. The scoop 10 may be opened and closed by one hand along hinged edge 101. The waste material is collected by closing the first and second jaws 100, 200 until the first jaw 100 is recessed into the second jaw 200.

When the waste material is collected and the first jaw 100 is recessed in the overlapping second jaw 200, the jaws 100 and 200 may be interlocked by the insertion of the tabs 150 and 161 into the respective tab-receiving slots 254 and 255, thereby locking the waste material in the cavities 175, 275 for disposal. The canted edges of the tabs 150 and 161 allow the tabs 150 and 161 to slide readily against the inside face of front panel 220 and through the slots 254 and 255 as the first jaw 100 is being recessed into the second jaw 200.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An integral, one-piece disposable scoop that is erectable from a collapsed, compact form to an expanded, operational form, for collecting and disposing of animal waste and the like comprising:

(a) a first jaw having a first scoop opening, said first scoop opening being formed within three upstanding sidewalls foldably erectable from a first jaw panel, including two triangular sidewalls and an end wall bridging said triangular sidewalls, said triangular sidewalls each having a locking tab projecting beyond said bridging end wall;

(b) a second jaw hingedly connected to said first jaw and having a second scoop opening, said second scoop opening being formed within three upstanding sidewalls foldably erectably from a second jaw panel, including two triangular sidewalls and an end wall bridging said triangular sidewalls, said bridging end wall having an opening sized and positioned to accept each of said locking tabs; and (c) means for hingedly connecting said first jaw panel to said second jaw panel, said first jaw being hingedly recessible into said second jaw, to simultaneously engage said locking tabs into said openings for locking closure of said jaws.

2. The apparatus of claim 1, wherein each said locking tab comprises a canted edge to allow said tab to be readily inserted in said opening.

3. The apparatus of claim 2, wherein said scoop further comprises handle means for gripping said scoop, affixed to said first and second jaw panels.

4. The apparatus of claim 3, wherein said handle means comprises a pair of handles, one said handle connected to a face of said first jaw panel, the other said handle connected to a face of said second jaw panel whereby said scoop may be opened and closed.

5. An integral, one-piece disposable scoop that is erectable from a collapsed, compact form to an expanded operational form, for collecting and disposing of animal waste and the like, comprising a first jaw and a second jaw hindedly connected together along an intermediate hinge line, each of said first and second jaws having foldable side walls respectively hinged to a foldable scoop wall which is substantially parallel to said hinge line, said side walls and said scoop wall being cumulatively foldable into flattened form and openable to form a jaw of generally triangular configuration; said first jaw in the opened form being sized to recess into said second jaw in the opened form; said first jaw having at least one locking tab projecting beyond its scoop wall, and said second jaw having at least one slot in its scoop wall alignable with said at least one projecting locking tab; and means for moving said first and second jaws about said hinge line to engage said at least one locking tab into locking engagement with said at least one slot.

6. The apparatus of claim 5, further comprising a toothed edge along each of said foldable scoop walls of said first and second jaws.

7. A substantially integral one-piece, disposable scoop that is erectable from a collapsed, compact form to an expanded, operational form and lockable in a locking form for collecting and disposing of animal waste and the like, comprising:

(a) a first hinged panel having first, second, third and fourth ends and an open face;

(b) a first front panel having a bottom end and a pair of side ends and hingedly connected to said first end of said first hinged panel;

(c) a pair of first side panels, one said first side panel hingedly connected to said second end of said hinged panel and one said side end of said first front panel, the other said first side panel hingedly connected to said third end of said first hinged panel and other said side end of said first front panel to form a first cavity;

(d) a first plurality of teeth along said bottom end of said first front panel;

(e) a second hinged panel having first, second, third, and fourth ends and an open face, said fourth end of said first hinged panel hingedly connected to said fourth end of said second hinged panel;

(f) a second front panel having a top end and a pair of side ends and hingedly connected to said first end of said second hinged panel;

(g) a pair of second side panels, one said second side panel hingedly connected to said second end of said second hinged panel and one said side end of said second front panel, the other said second side panel hingedly connected to said third end of said second hinged panel and other said side end of said second front panel to form a second cavity, each said first and second side panels including a crease allowing said side panels to fold, said first hinged, first front, first side, second hinged, second front, and second side panels foldable outwardly, said second side and front panels overlapping said first side and front panels in the locking form;

(h) a second plurality of teeth along said top end of said second front panel;

(i) a plurality of braces, each said brace hingedly connected to one said side end of said front panels and connected to one said side panel, said braces lying facially adjacent said front panels in the collapsed compact form, said braces being foldable outwardly, said braces being facially adjacent said side panels in the expanded operational form;

(j) a first tab connected to and protruding from one said first side panel;

(k) a first tab-receiving slot formed in one said side end of said second front panel for receiving said first tab, said first tab corresponding to and insertable in said first tab-receiving slot;

(l) a second tab connected to and protruding from other said first side panel;

(m) a second tab-receiving slot formed in other said side end of said second front panel for receiving said second tab, said second tab corresponding to and insertable in said second tab-receiving slot, each said tab having a canted edge to allow said tabs to be readilly inserted in said tab-receiving slots;

(n) a first handle connected to said open face of said first hinged panel for handling said first hinged panel; and (o) a second handle connected to said open face of said second hinged panel for handling said second hinged panel whereby said scoop lies flat in the collapsed, compact form, is erectable to the expanded, operational form by folding said panels outwardly along said hinged connections and said creases, is braceable by said braces lying facially adjacent said side panels, is operable by utilizing said handles to open and close said faces and said scoop, and is lockable to the locking form by inserting said tabs in said tab-receiving slots.

8. A substantially integral and one-piece disposable scoop that is erectable from a collapsed, compact form to an expanded, operational form and to a locked form for collecting and disposing of animal waste and the like, comprising:

(a) a first and second jaw hingedly connected together along an intermediate hinge line, each of said first and second jaws having foldable sidewalls respectively hinged to a foldable scoop wall which is substantially parallel to said hinge line, said sidewalls and said scoop wall being cumulatively foldable into the collapsed, compact form and operable to form a jaw of generally triangular configuration, said first jaw in the expanded, operational form being sized to recess into said second jaw in the expanded, operational form to construct the locked form;

(b) bracing means connected to said scoop wall for bracing said foldable sidewalls, said bracing means remaining unfolded and rigid in the collapsed, compact form, the expanded, operational form and the locked form;

(c) locking means for locking said first jaw into a recessed position in said second jaw, operable by recessing said first jaw into said second jaw;

(d) tooth means connected to said first and second jaws for readily scooping animal waste; and (e) handle means connected to said first and second jaws for moving said first and second jaws about said hinge line.

9. The apparatus of claim 8 wherein said bracing means comprises a brace hingedly connected to said scoop wall, said brace lying facially adjacent said scoop wall in the collapsed, compact form and facially adjacent one of said sidewalls in the expanded, operational form and the locked form.

10. The apparatus of claim 8 wherein said locking means comprises at least one projecting tab on said first jaw scoop wall and at least one opening through said second jaw scoop wall, said at least one tab and said at least one opening coming into alignment when said first jaw is recessed into said second jaw.

11. The apparatus of claim 8 wherein said tooth means comprises a toothed edge along each of said foldable scoop walls of said first and second jaws.

12. The apparatus of claim 8 wherein said handle means comprises a pair of handles, one said handle connected to said first jaw, the other said handle connected to a face of said second jaw.

* * * * *